United States Patent [19]

Ito

[11] Patent Number: 4,816,867

[45] Date of Patent: Mar. 28, 1989

[54] ELECTROPHOTOGRAPHIC COPYING MACHINE

[75] Inventor: Masazumi Ito, Toyohashi, Japan

[73] Assignee: Minolta Camera Kabushiki Kaisha, Osaka, Japan

[21] Appl. No.: 99,389

[22] Filed: Sep. 21, 1987

[30] Foreign Application Priority Data

Sep. 22, 1986 [JP] Japan ..... 61-224248

[51] Int. Cl.[4] ..... G03G 15/00

[52] U.S. Cl. ..... 355/14 SH; 355/3 SH

[58] Field of Search ..... 355/14 SH, 3 SH, 8, 355/3 R, 14 R

[56] References Cited

U.S. PATENT DOCUMENTS 4,547,062 10/1985 Fujiwara ..... 355/14 SH 4,669,858 6/1987 Ito et al. ..... 355/14 SH

FOREIGN PATENT DOCUMENTS 59-216158 6/1984 Japan .

60-98460 1/1985 Japan .

*Primary Examiner*—R. L. Moses

*Attorney, Agent, or Firm*—Burns, Doane, Swecker & Mathis

[57] ABSTRACT

An electrophotographic copying machine comprising a document supporting glass plate for supporting an original document thereon, an optical system for scanning the document on the document supporting glass plate, a photoreceptor drum for recording the image of the document scanned by the optical system, and timing rollers for feeding copying paper to which the image on the photoreceptor drum is transferred. The document supporting glass plate defines a reference position with respect to a direction of scanning by the optical system. The timing rollers are controllable such that the image present on the photoreceptor drum when the optical system scans the reference position is transferred to a central position of the copying paper with respect to a copying paper feed direction.

10 Claims, 27 Drawing Sheets

※ ①MAIN MOTOR
②DEVELOPER MOTOR
③TIMING ROLLER CLUTCH
④A PAPER FEED CLUTCH
⑤ B PAPER FEED CLUTCH
⑥ CHARGE
⑦ TRANSFER

ELECTROPHOTOGRAPHIC COPYING MACHINE

BACKGROUND OF THE INVENTION (1) Field of the Invention

The present invention relates to an electrophotographic copying machine for copying an original document placed in a predetermined position on a document supporting glass plate to a selected position such as a central position of copying paper.

(2) Description of the Prior Art

The electrophotographic copying machine generally takes copies of an original document placed on the document supporting glass plate with an end of the document extending along an end of the glass plate, whereby the copies are transferred to copying paper having an end thereof in register with the end of the document. In other words, a position adjusting control is effected through timing rollers for feeding the copying paper such that the ends of the document and the copying paper coincide with each other. This control has no problem where both the document and copying paper are in a regular size. However, where either the document or the copying paper is outside regular sizes as, for example, when copying a message or a title to a central position of a wrapping paper or a cover sheet and the original document is smaller than the copying paper, there arises the problem of a copied image being positioned too close to the forward end of copying paper.

In order to solve this problem, a proposal has been made in the Japanese laid open patent application (Kokai) under No. 59-216158. In the copying machine disclosed therein, an original document is set by an automatic document feeder to such a position on the document supporting glass plate that its image is copied to the center of copying paper and, thereafter, copies are taken under control effected through the timing rollers as noted above. In this prior copying machine, however, the timing rollers are controlled to feed the copying paper so that its forward end comes into register with the forward end of the document set to an end position of the document supporting glass plate. The document must, therefore, be set to different positions depending on the sizes of the copying paper and on the copying magnifications. This entails complications in the control for the automatic document feeder and, when the automatic document feeder is not used, presents difficulties in setting the original document to a correct position. It also has the disadvantages of consuming time for selecting the document position and causing incorrect setting of the original document. Furthermore, where the copying paper has a great length or in the case of a great magnification, the document setting position must be outside the document supporting glass plate, which makes a copying operation impossible.

SUMMARY OF THE INVENTION

The object of the present invention is to provide an electrophotographic copying machine capable of copying a document to the center of copying paper and of taking copies by setting the document to a predetermined position regardless of the copying paper size and the copying magnifications.

In order to fulfill this object, an electrophotographic copying machine according to the present invention comprises a document supporting glass plate for supporting an original document thereon; a scanner for scanning the document on the document supporting glass plate; a photoreceptor drum for recording an image scanned by the scanner; timing rollers for feeding copying paper to which the image on the photoreceptor drum is transferred; a reference position defined on the document supporting glass plate with respect to a direction of scanning by the scanner; and timing roller control means for controlling the timing rollers such that the image present on the photoreceptor drum when the scanner scans the reference position is transferred to a central position of the copying paper with respect to a copying paper feed direction.

The above construction is capable of copying the document to the center of copying paper, and allows copies to be taken easily by setting the document to a predetermined reference position regardless of copying paper sizes and copying magnifications. Consequently, this construction allows the document to be set with great ease, and facilitates controls for the automatic document feeder when the automtic document feeder is used. When the document is set manually, little time is consumed to select a position to which the document should be set and there is no possibility of incorrectly setting the document. Furthermore, copies may be taken to the center of copying paper even where the copying paper has a great length or in the case of a great magnification. Sizes of copying paper to be fed manually may be registered in advance or may be input whereby copies are taken to a sheet of paper outside regular sizes, such as a wrapping paper or a cover sheet, as in the case of copying to regular size paper.

BRIEF DESCRIPTION OF THE DRAWINGS

These and other objects, advantages and features of the present invention will become apparent from the following description of preferred embodiments thereof taken in conjunction with the following accompanying drawings.

DETAILED DESCRIPTION OF THE PREFERRED EMBODIMENTS

An embodiment of the present invention will be described hereinafter with reference to the drawings.

Figure 1:
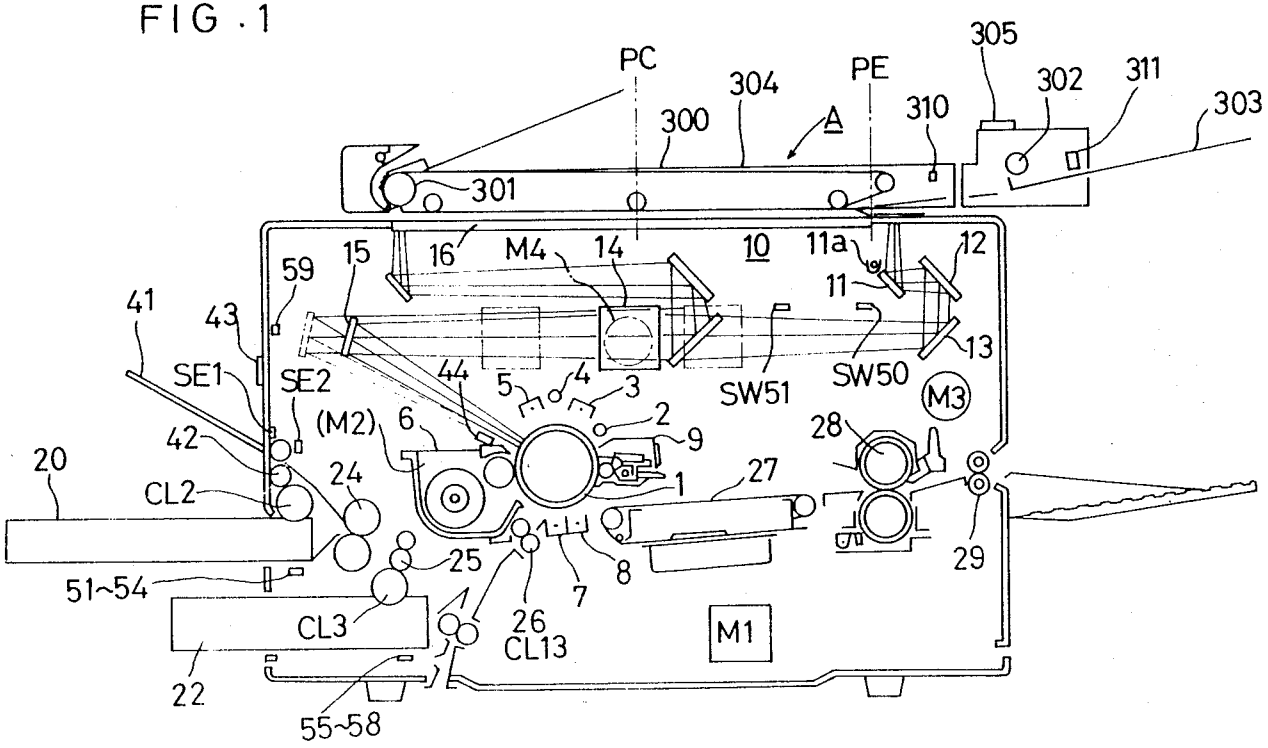
FIG. 1 is a front view in vertical section schematically showing an example of a copying machine according to the present invention.

FIG. 1 is a sectional front view schematically illustrating a copying machine A. As shown, a photoreceptor drum 1 is mounted approximately at a central portion of a machine housing for rotation in the counterclockwise direction. The drum 1 is surrounded by a main eraser lamp 2, a sub-charger 3, a sub-eraser lamp 4, a main charger 5, a developing device 6, a transfer charger 7, a charge eraser 8 for copying paper, and a blade type cleaning device 9. The photoreceptor drum 1 has a photosensitive layer on its surface which is charged and sensitized as it passes by the eraser lamps 2 and 4 and chargers 3 and 5, and receives an image exposure from an optical system 10.

The optical system 10 is disposed below a document supporting glass plate 16 to scan a document image, and comprises a light source 11*a*, movable mirrors 11, 12 and 13, a lens 14, and a mirror 15. The light source 11*a* and the movable mirror 11 are driven by a scan motor M3 to move leftward at a velocity v/n (wherein n represents magnification) with respect to a peripheral velocity n of the photoreceptor drum 1 which is constant whether real-size copying or variable magnification copying. The movable mirrors 12 and 13 are driven to move leftward at a velocity v/2n. The lens 14 is movable along an optical ,axis and the mirror 15 can oscillate when the magnification is varied. Such a magnification varying means is well known and will not be particularly described herein.

The machine housing includes an upper paper feed section 20 and a lower paper feed section 22 at a left-hand side thereof. A transport passage for the copying paper includes roller pairs 24 and 25, a timing roller pair 26, a conveyor belt 27, a fixing device 28 and a discharge roller pair 29. A manual feed table 41 for enabling manual feeding of copying paper is provided above the upper paper feed section 20 to open and close relative to the machine housing. Adjacent the manual feed table 41 there are sensors SE1 and SE2 for detecting copying paper fed from the manual feed table 41, a roller pair 42, a control panel 43 for manual feed copying, and a sensor 59 for detecting the opening and closing of the manual feed table 41. The upper paper feed section 20 and the lower paper feed section 22 have sensors 51–54 and sensors 55–58 for detecting the sizes of copying paper fed therefrom, respectively. Number 44 indicates an eraser acting as a side eraser and interimage eraser.

There is an automatic document feeder 300 mounted on top of the machine housing. The automatic document feeder 300 includes a document tray 303, a sensor 311 for detecting presence or absence of documents on the document tray 303, a motor 302 for feeding the documents, a sensor 310 for detecting incoming documents, a conveyor belt 304 for transporting the documents to a predetermined position on the document supporting glass plate 16, and a motor 301 for driving the conveyor belt 304. A control panel 305 is also provided for operating the automatic document feeder 300.

Figure 2:
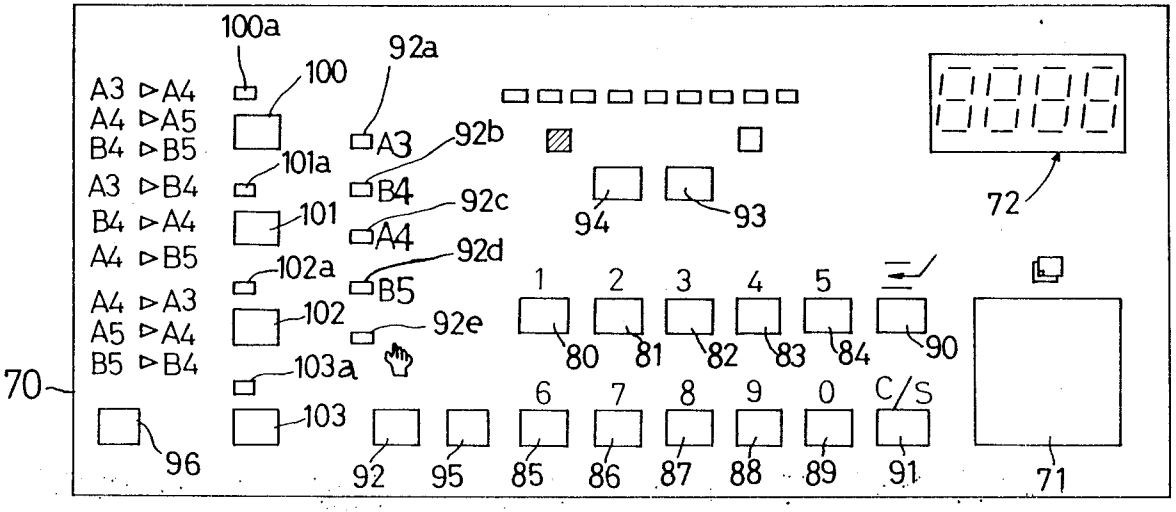
FIG. 2 is a plan view of a control panel of the copying machine.

FIG. 2 shows an arrangement of various control keys in a control panel section of the copying machine A. A control panel 70 includes a print key 71 for starting a copying operation, a number indicator 72 comprising 7-segment light emitting diodes for indicating 4-digit numbers, ten keys 80–89 corresponding to numbers "1", "2"–"9" and "0", respectively, an interrupt key 90 for setting interrupt copying, a clear-stop key 91, a paper select key 92 for selecting a size of copying paper contained in paper feed cassettes arranged one above the other and for selecting copying paper manually fed from the manual feed table 41, size indicators 92*a*–92*d* for indicating a selected size of copying paper, a manual feed indicator 92*e* for indicating selection of copying paper fed manually, up and down keys 93 and 94 for varying copy image density stepwise, and copying magnification setting keys 101–103. Copying magnifications corresponding to these magnification setting keys 101–103 are stored beforehand in a memory to be described later, and copies are taken in such magnifications by selectively pressing the keys 101–103.

An X-key 95 is an input key used for inputting a size of copying paper fed manually, which keys in between numerical value inputting for a longitudinal dimension and numerical value inputting for a transverse dimension. An image regist select key 96 is an input key for mode selection between an ordinary mode and a center regist mode. In the ordinary mode, copies are taken with an end of a document placed in register with an end position PE of the document supporting glass plate 16, whereby the document is copied on recording paper having an end in agreement with the end of the document. In the center regist mode, the document is set to a central position PC of the document supporting glass plate 16, whereby the document is copied on a mid-position of copying paper with respect to a direction of copying paper transport.

Figure 3:
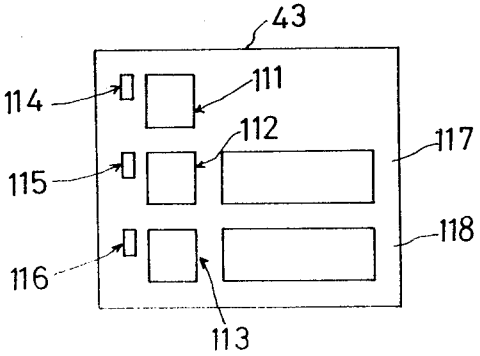
FIG. 3 is a plan view of a control panel for a manual feed mode of the copying machine.

FIG. 3 shows the control panel 43 for a manual paper feed copying operation. Number 111 indicates a size input switch for registering sizes of manually fed copying paper. Number 114 is a lamp for indicating that a paper size is being registered. Numbers 112 and 113 indicate select switches for selecting the sizes of manually fed copying paper. Numbers 115 and 116 are lamps for indicating that the registered sizes of manually fed copying paper are selected, respectively. Numbers 117 and 118 are spaces for writing the registered sizes by way of memorandum.

Figure 4:
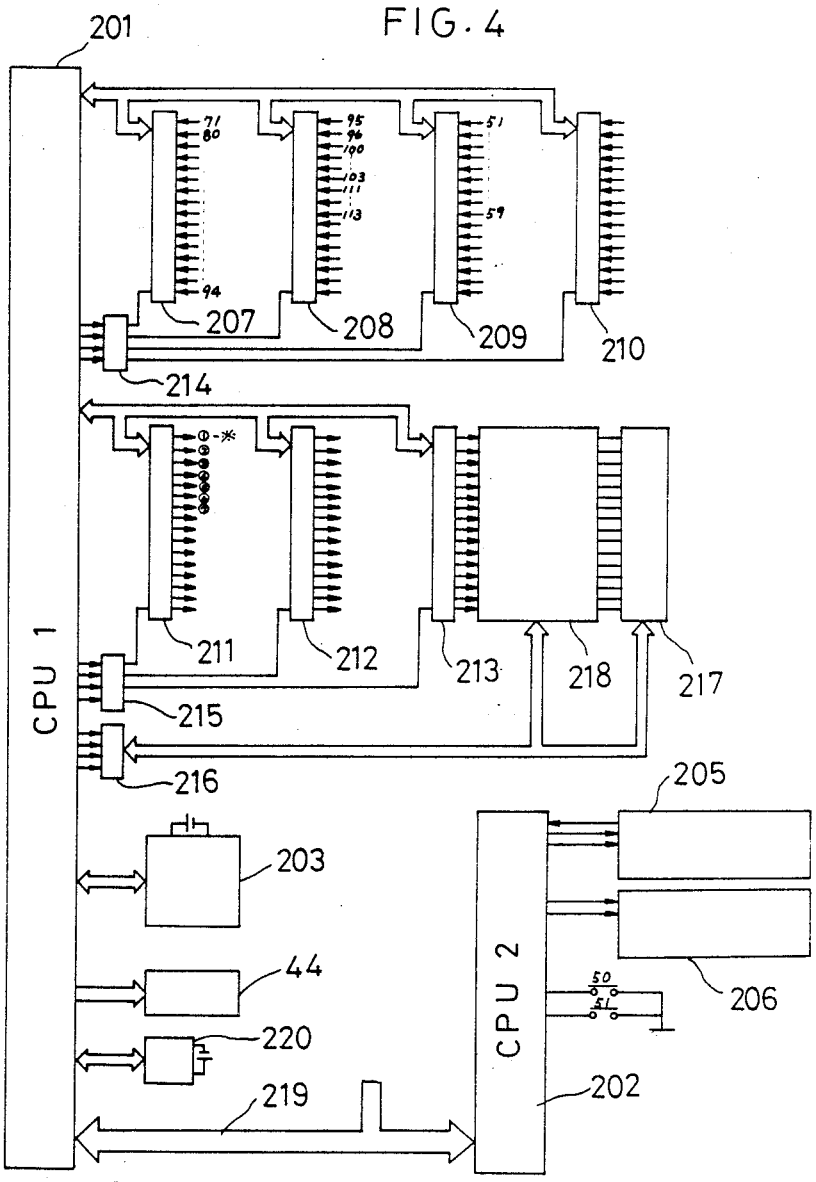
FIG. 4 is a block diagram of a control circuit of the copying machine.

FIG. 4 shows a control circuit of the copying machine A. Number 201 indicates a first CPU. Number 202 indicates a second CPU. Number 203 indicates a battery-backed RAM. Number 205 indicates a drive circuit for driving a D.C. motor M3 for document scanning. Number 206 indicates a drive circuit for driving a stepper motor M4 for magnification variations. Numbers 207–213 indicate input/output ports comprising programmable integrated circuits for input/output extensions. Numbers 214–216 indicate decoders. Number 217 indicates a light emitting diode matrix. Number 218 indicates a fluorescent display tube. Number 219 indicates a communication line for interconnecting different CPUs. Number 220 indicates a battery-backed RAM for storing sizes of manually fed copying paper.

Figure 5:
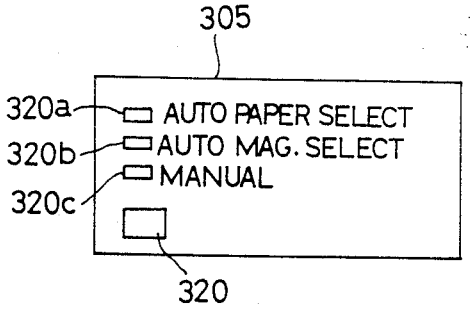
FIG. 5 a plan view of a control panel for an automatic document feeder.

FIG. 5 shows the control panel 305 of the automatic document feeder 300, which includes a mode select switch 320 for selecting one of an automatic paper select mode, an automatic magnification select mode and a manual mode. Number 320*a*–320*c* are lamps for indicating selection of these modes, respectively.

Figure 6:
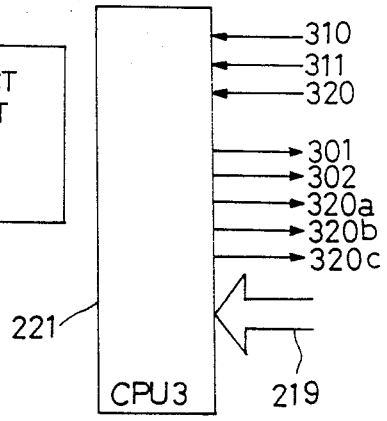
FIG. 6 is a block diagram of a control circuit for the automatic document feeder.

FIG. 6 shows a control circuit of the automatic document selector 300, which includes a third CPU 221 connected to the first CPU 201 by the communication line 219.

Figure 7A:
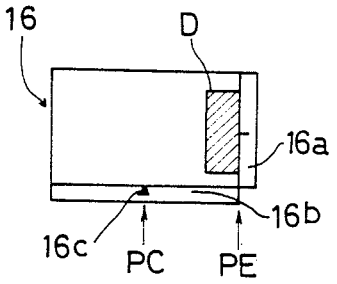
FIGS. 7(*a*), 7(*b*) and 7(*c*) are explanatory views for illustrating a copying operation in an ordinary mode.
Figure 7B:
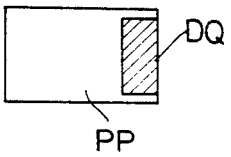
Figure 7C:
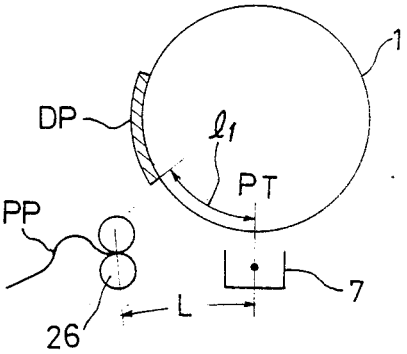

FIGS. 7(*a*)–(*c*) and 8(*a*)–(*c*) are explanatory views illustrating copying operations in the ordinary mode and the center regist mode selected by the image regist select key 96, respectively.

FIG. 7(*a*) shows a position of document D in the ordinary mode, with an end of document D in register with the end position PE of the document supporting glass plate 16. FIG. 7(*b*) shows a position of a copied image DQ with the end of the document D in register with an end of copying paper PP. FIG. 7(*c*) shows a control state of the timing rollers 26 to realize the above. In FIG. 7(*c*), copying paper PP is in a standby position in contact with the timing rollers 26 at rest. The timing rollers 26 are started when a distance l1, measured from a forward end of image DP formed and developed on the photoreceptor drum 1 by a scanning action of the optical system 10 to a transfer position PT where the transfer charger 7 is disposed, equals a distance L from a forward end of the copying paper PP to the transfer position PT. This causes the forward end of copying paper PP to reach the transfer position PT simultaneously with the forward end of image DP which is advanced by the rotation of photoreceptor drum 1, which results in the copy shown in FIG. 7(*b*).

Figure 8A:
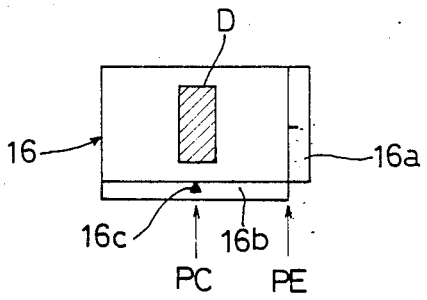
FIGS. 8(*a*), 8(*b*) and 8(*c*) are explanatory views for illustrating a copying operation in a center regist mode.
Figure 8B:
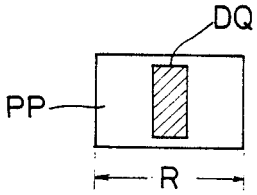
Figure 8C:
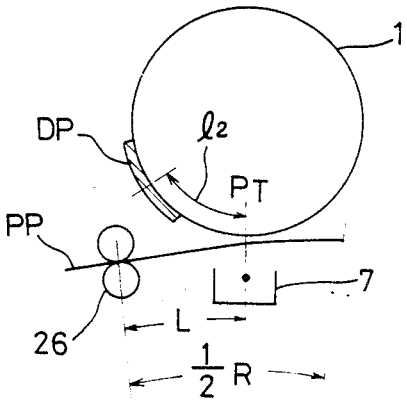

FIG. 8(*a*) shows a position of document D in the center regist mode, with the center of document D in register with the central position PC of the document supporting glass plate 16. FIG. 8(*b*) shows a position of copied image DQ with the center of the document D in register with the center of copying paper PP. FIG. 8(*c*) shows a control state of the timing rollers 26 to realize the above.

In FIG. 8(*c*), the copying paper PP is standing still after having been advanced a distance R/2 corresponding to half of a length R of the copying paper PP in the transport direction thereof. From this standby position the timing rollers 26 are started when a distance l2, measured from the center of image DP formed and developed on the photoreceptor drum 1 by the scanning action of the optical system 10 to the transfer position PT, equals distance L from the forward end of the copying paper PP to the transfer position PT. This brings the center of image DP into register with the center of copying paper PP. The center of image DP formed on the photoreceptor drum 1 is the position exposed when the optical system scans the central position PC of the document supporting glass plate 16 in the transport direction. Such a position can be detected in the control circuit. The length R of copying paper PP is input in accordance with the flowchart shown in FIG. 17 in the case of automatic paper feeding, and in accordance with the flowchart shown in FIG. 12 in the case of manual paper feeding, and the paper length stored in the RAM 220 is loaded in accordance with the flowcharts shown in FIGS. 14 and 15.

As shown in FIGS. 7(*a*) and 8(*a*), scales 16*a* and 16*b* are provided along a righthand side and a lower side of the document supporting glass plate 16. The scale 16*b* includes a marker 16*c* in a mid-position thereof indicating the central position PC of the document supporting glass plate 16. The document D is set in position by the automatic document feeder 300 in accordance with the ordinary mode or the center regist mode. When the automatic document feeder 300 is not used, the document D is manually set to the end position PE or the central position PC in accordance with a selected mode, by placing the document D along the scale 1 at the end of the document supporting glass plate 16 or by using the marker 16*c* as a guide.

FIGS. 9 through 21 show the sequence of controls carried out by the first CPU 201.

Figure 9:
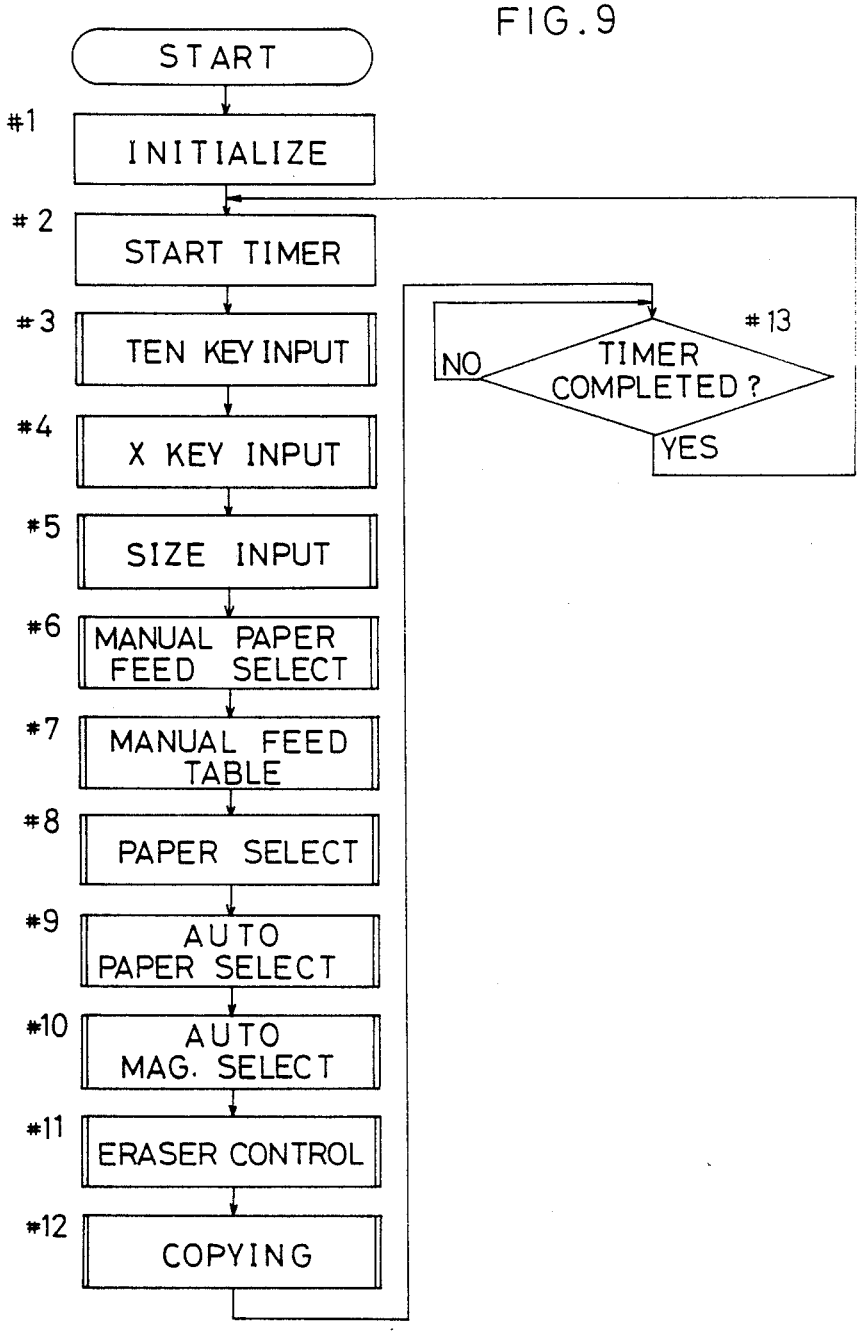
FIGS. 9, 10, 11, 12, 13, 14, 15, 16, 17, 18, 19, 20 and 21 are flowcharts showing processing sequences executed by a first CPU.

FIG. 9 schematically shows the entire control sequence carried out by the first CPU 201. When the program starts, a subroutine is first executed at step #1 for initializing the first CPU 201 and the copying machine A. At step #2, an internal timer of the first CPU 201 is set, and thereafter subroutines are called in succession at steps #3 to #12. This control routine ends with completion of the internal timer at step #13. Though not illustrated, the first CPU 201 communicates data with other CPUs 202 and 221 after all of the subroutines are called.

Figure 10:
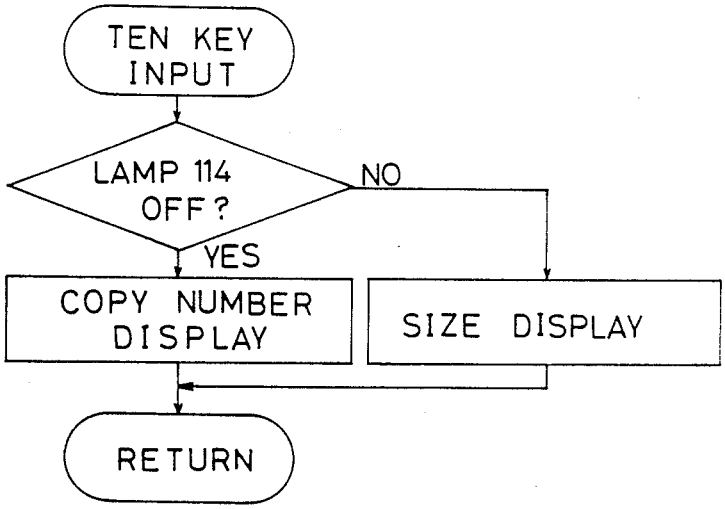

FIG. 10 shows a ten key input subroutine. The value input through the ten keys is regarded as the number of copies to be taken when the lamp 114 for indicating that the size of copying paper fed manually is being registered is off, that is to say during the normal mode, and as the size of copying paper fed manually when the lamp 114 is on.

Figure 11:
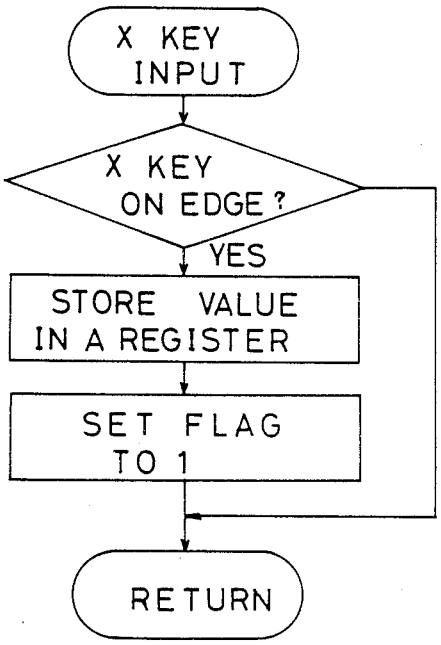

FIG. 11 shows an input subroutine for X-key 95. At the on-edge of X-key 95, the value indicated by the number indicator 72 is stored in A register in RAM 220 and a transverse flag for indicating that the transverse size of manually fed copying paper is being input is set to "1".

Figure 12A:
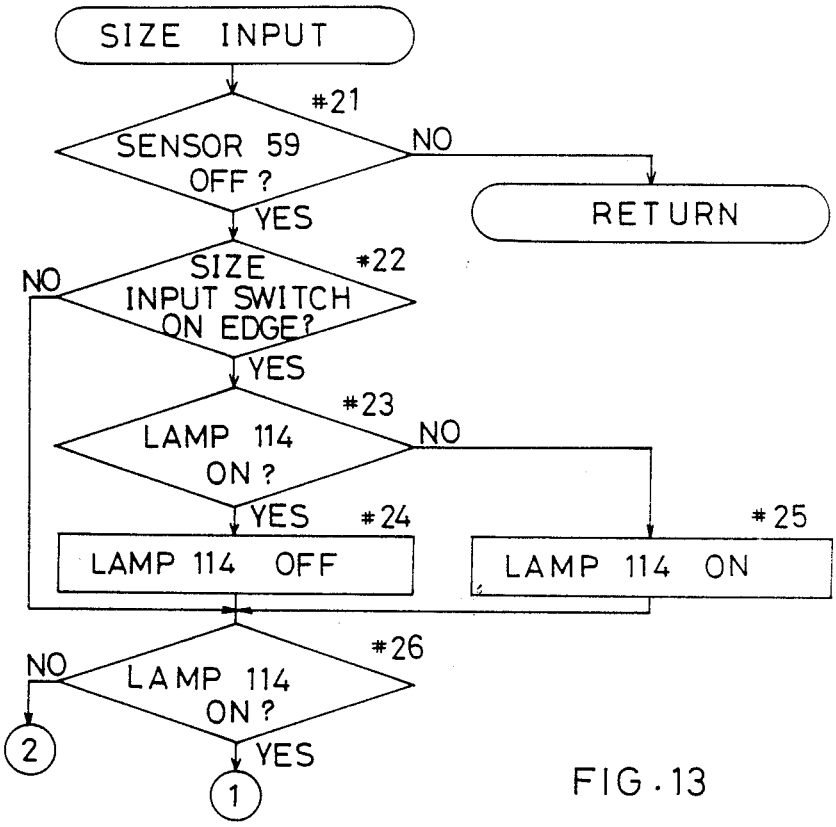
Figure 13:
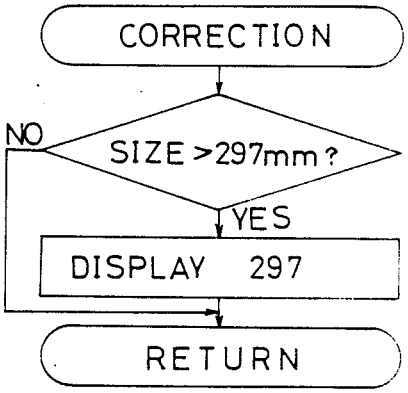
Figure 12B:
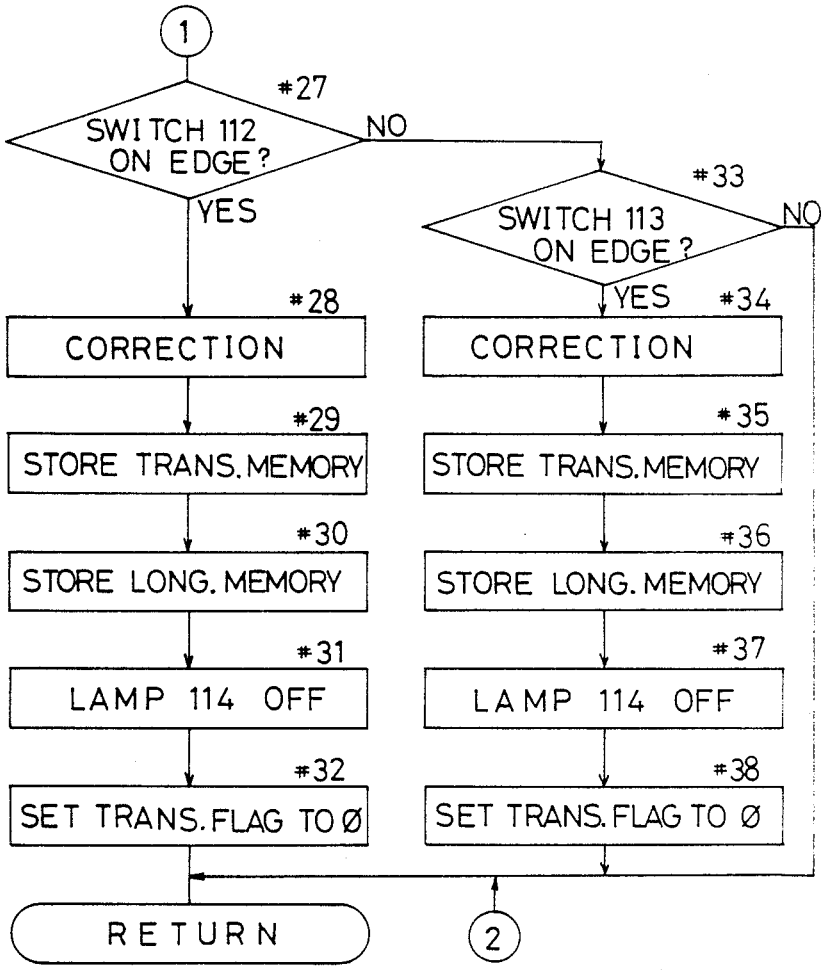

FIG. 12 shows a size input subroutine. Step #21 judges the state of sensor 59 for detecting the opening and closing of the manual paper feed table 41. If the sensor 59 is on, that is if the manual paper feed table 41 is closed, the subroutine makes a return. If the manual paper feed table 41 is open, judgment is made at step #22 as to whether the size input switch 111 is in on-edge state or not. If it is, an on/off state of the indicator lamp 114 is reversed at steps #23, #24 and #25. Step #26 judges the state of lamp 114 and, if the lamp 114 is on, steps #28 to #32 or steps #34 to #38 are executed depending on on-edge states of the select switches 112 and 113. Step #28 is for executing a correction routine which, as shown in FIG. 13, judges whether or not the input transverse size of copying paper exceeds a maximum size, such as 297 mm, of the document supporting glass plate 16. If it does, the value is forcibly corrected to the maximum size, such as "297" and, a corresponding indication is given. At step #29 this value is stored as a transverse memory for the select switch 112, and at step #30 the value of A register is stored as a longitudinal memory. At step #31 the indicator lamp 114 is turned off, and at step #32 the transverse flag is set to "0". Steps #34 to #38 carry out a similar operation with respect to the select switch 113.

Figure 14:
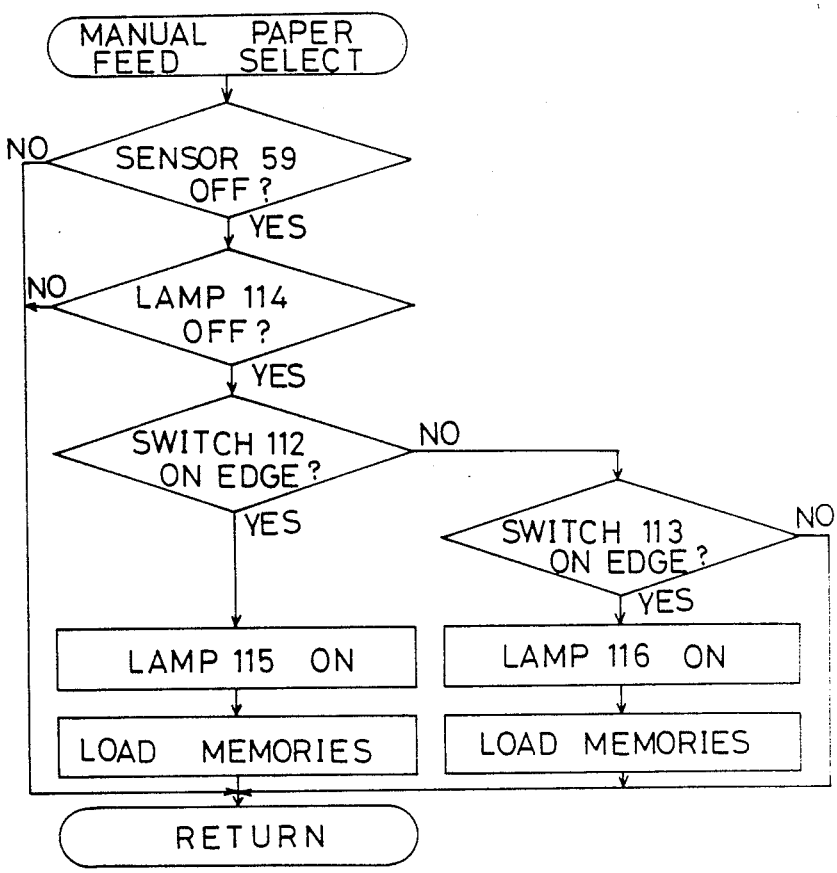

FIG. 14 shows a manual feed paper select subroutine. If the indicator lamp 114 is off when the sensor 59 is off with the manual paper feed table 41 open, the indicator lamp 115 or 116 is turned on by the on-edge state of select switch 112 or 113. Then the longitudinal memory and transverse memory of the select switch 112 or 113 are loaded as control data on a working register.

Figure 15:
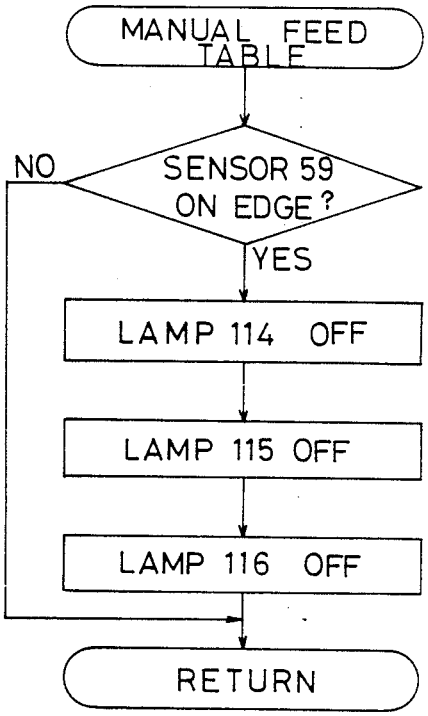

FIG. 15 is a manual feed door subroutine. This subroutine judges the opening and closing of the manual paper feed table 41 by the on-edge state of sensor 59, and turns off the indicator lamps 114, 115 and 116 when the paper feed table 41 is closed.

Figure 16:
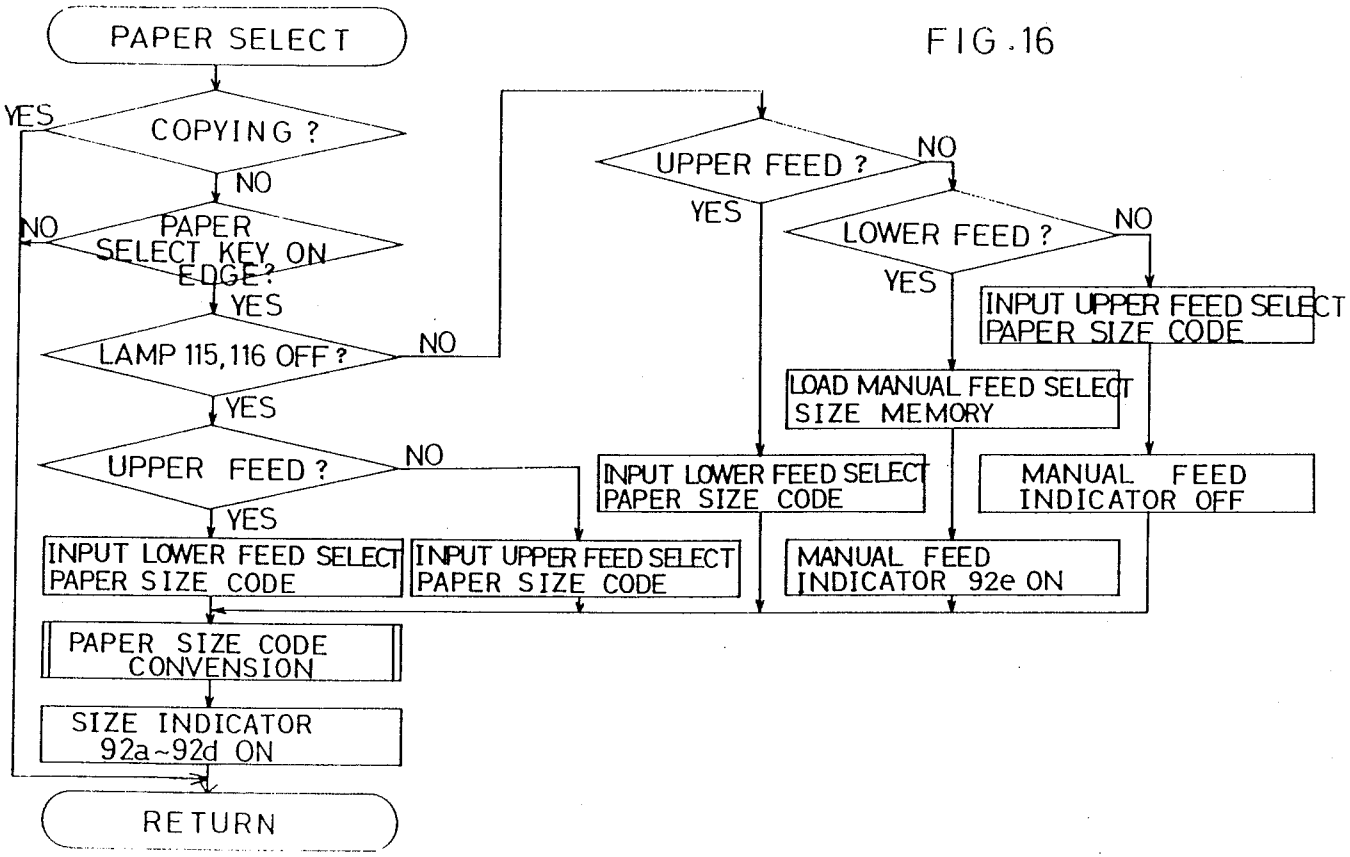

FIG. 16 shows a paper select subroutine. If the paper select key 92 is pressed when a copy is not being taken, the selection between the upper paper feed section 20 and the lower paper feed section 22 is reversed and a paper size code provided by the sensors 51–58 is input provided that both the indicator lamps 115 and 116 are off when an on-edge state resulting from the paper select key depression is detected. If either of the indicator lamps 115 and 116 is on, a selection is made through a circuit of the upper and lower paper feed sections 20 and 22 and the manual paper feed table 41, and the respective paper feed codes are input. When the manual paper feed table 41 is selected, the manual feed indicator **92*e* is turned on. Thereafter a paper size code conversion routine is executed to turn on one of the size indicators 92*a* to 92*d*** corresponding to a selected paper size.

Figure 17:
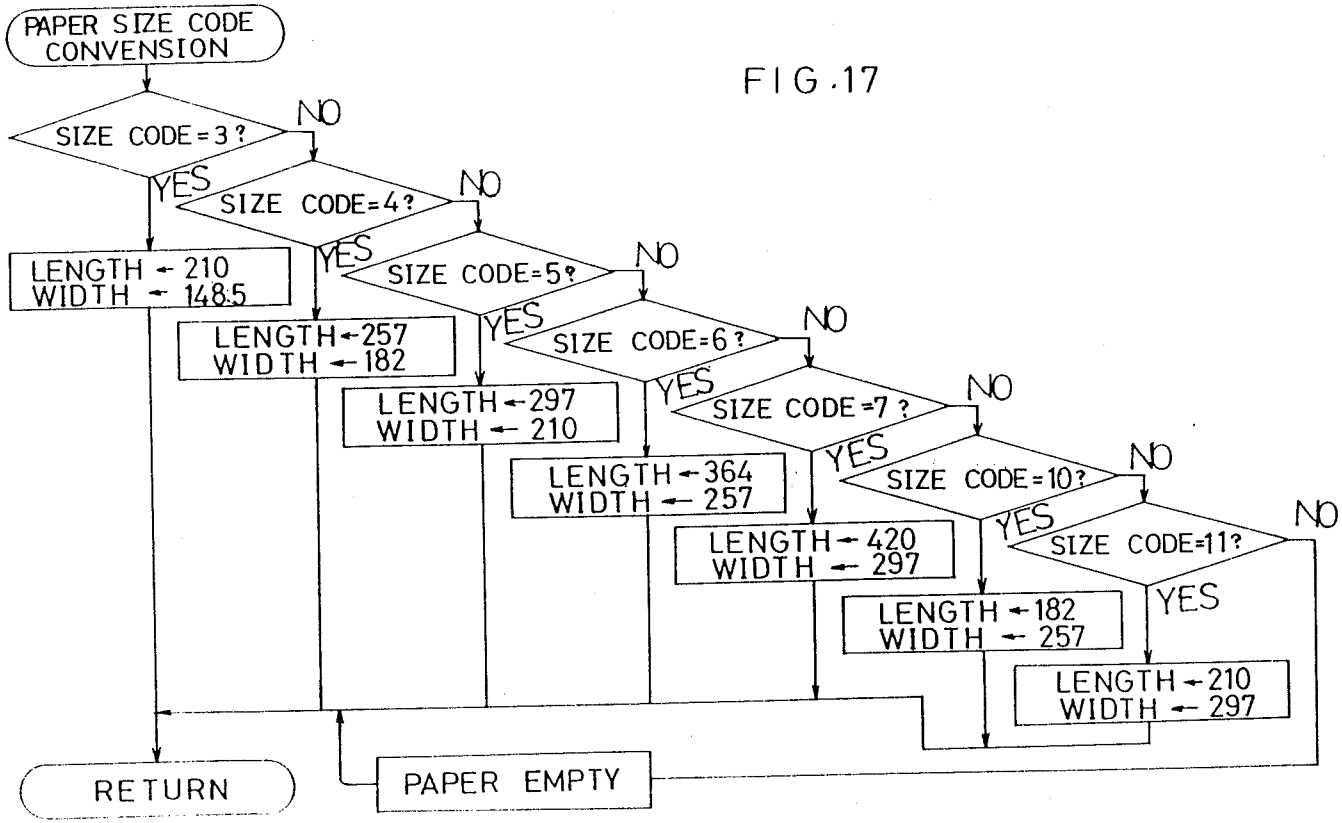

FIG. 17 shows the paper size code conversion routine. If the input paper size code is "3", it signifies A5 longitudinal size and paper length "210" and paper width "148.5" are momorized. Paper lengths and paper widths corresponding to other paper size codes are memorized similarly. A paper empty indication is given in the absence of a corresponding paper size code.

Figure 18:
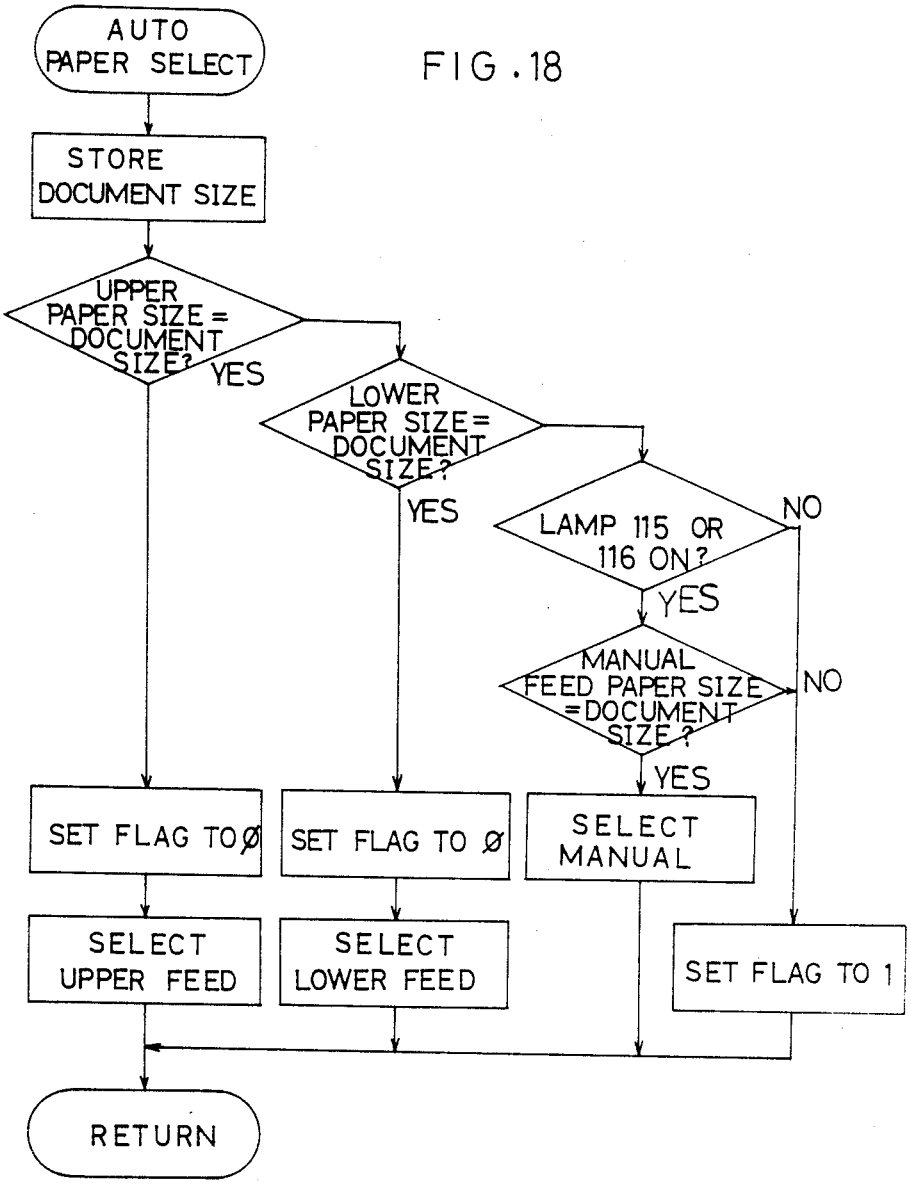

FIG. 18 shows an automatic paper select subroutine. Data of a document size detected by the automatic document feeder 300 is transmitted from the third CPU 221 through the communication line 219. This document size data is once stored in the A register. Then the content of A register is compared with the paper size at the upper paper feed section 20. If they agree, a size disagreement flag is set to "0" and the upper paper feed section 20 is selected. If the content of A register differs from the paper size at the upper paper feed section 20, similar comparisions are made successively with the paper at the lower paper feed section 22 and with the paper fed through the manual feed table 41. If the content of A register finds no corresponding size, the size disagreement flag is set to "1".

Figure 19:
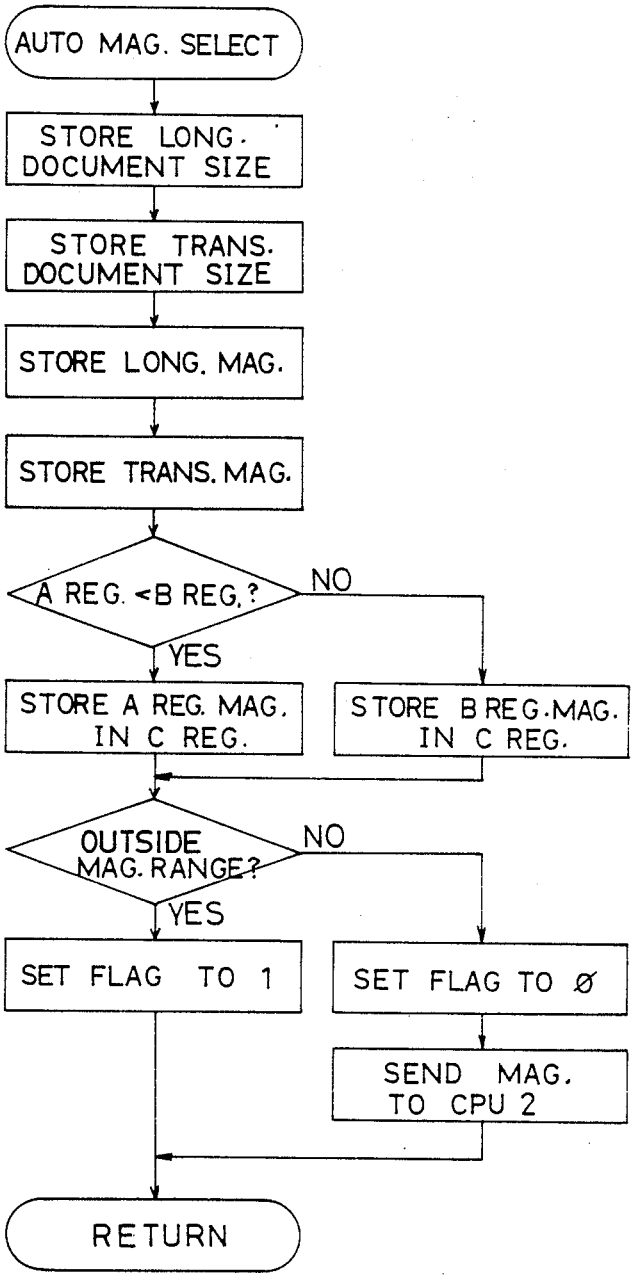

FIG. 19 shows an automatic magnification select subroutine. A longitudinal size and a transverse size in the document size data received from the third CPU 221 are stored in A register and B register, respectively. Thereafter, magnifications are obtained by dividing the paper length and paper width by the contents of A register and B register, and the results are stored in A register and B register, respectively. The two magnifications are compared, and the smaller magnification is stored in C register. If the value of C register is outside a magnification range of the copying machine A, a magnification disagreement flag is set to "1". If this value is within the magnification range, the magnification disagreement flag is set to "0" and the value is transmitted to the second CPU 202.

Figure 20:
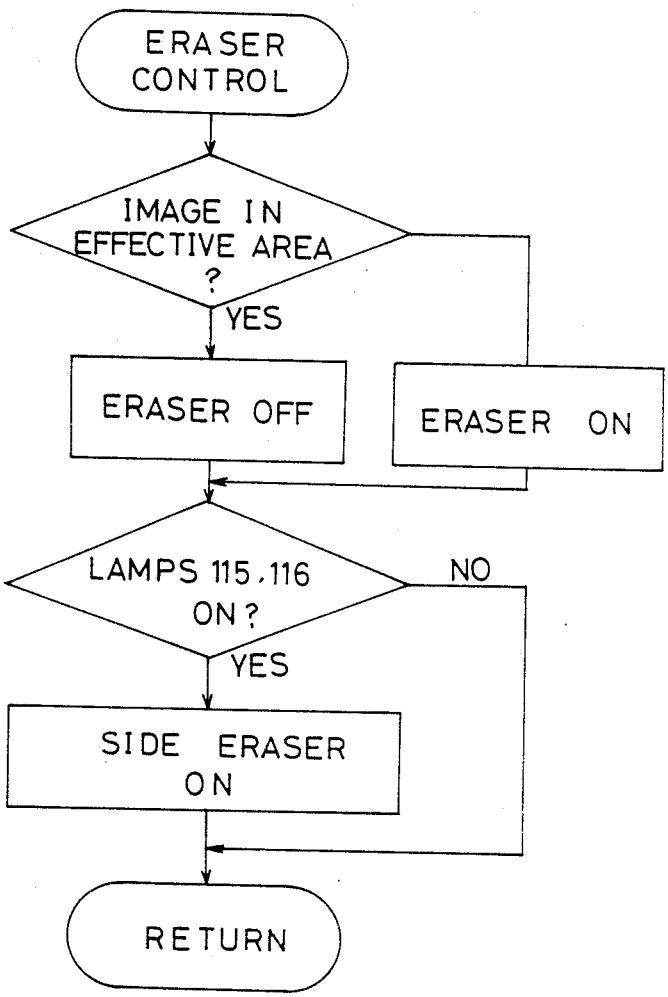
Figure 21A:
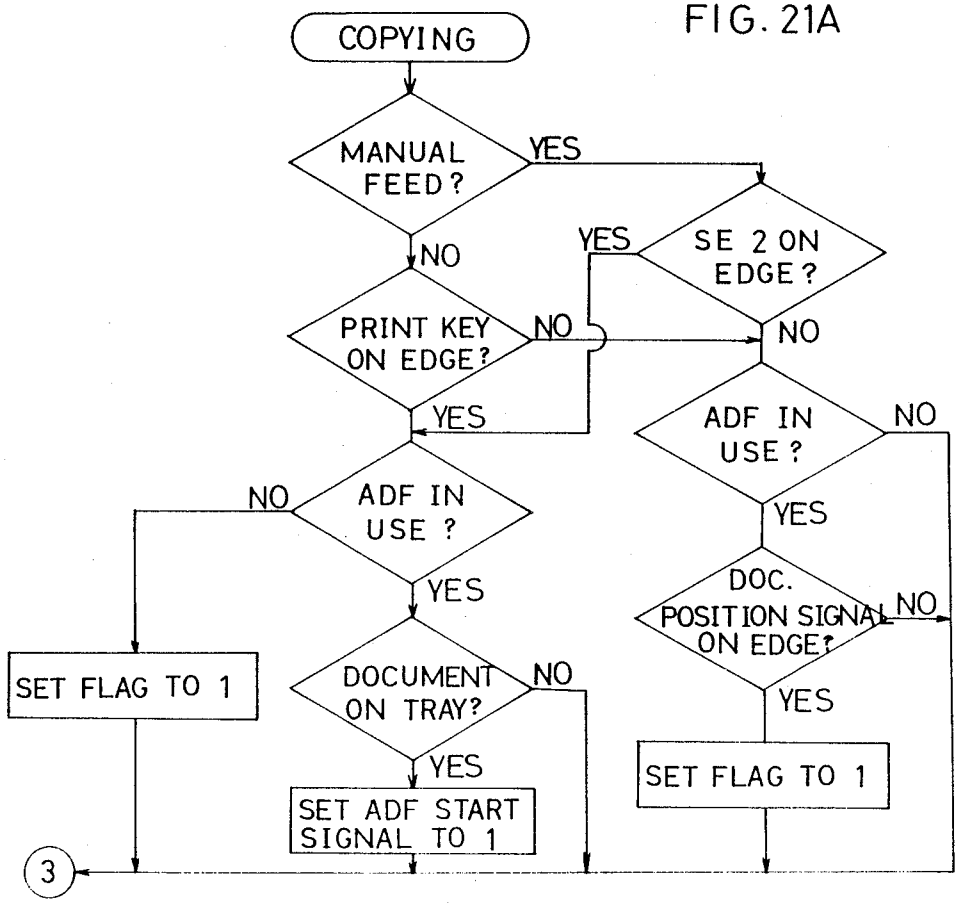
Figure 21B:
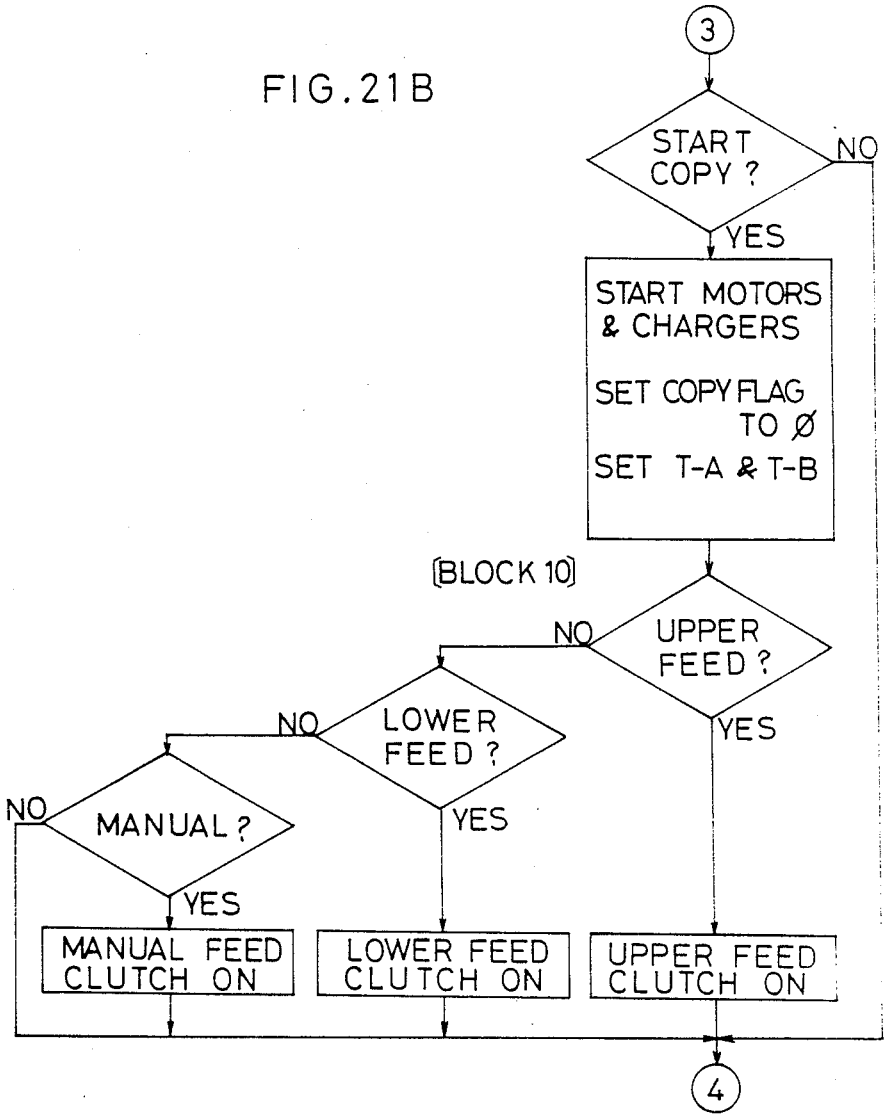
Figure 21C:
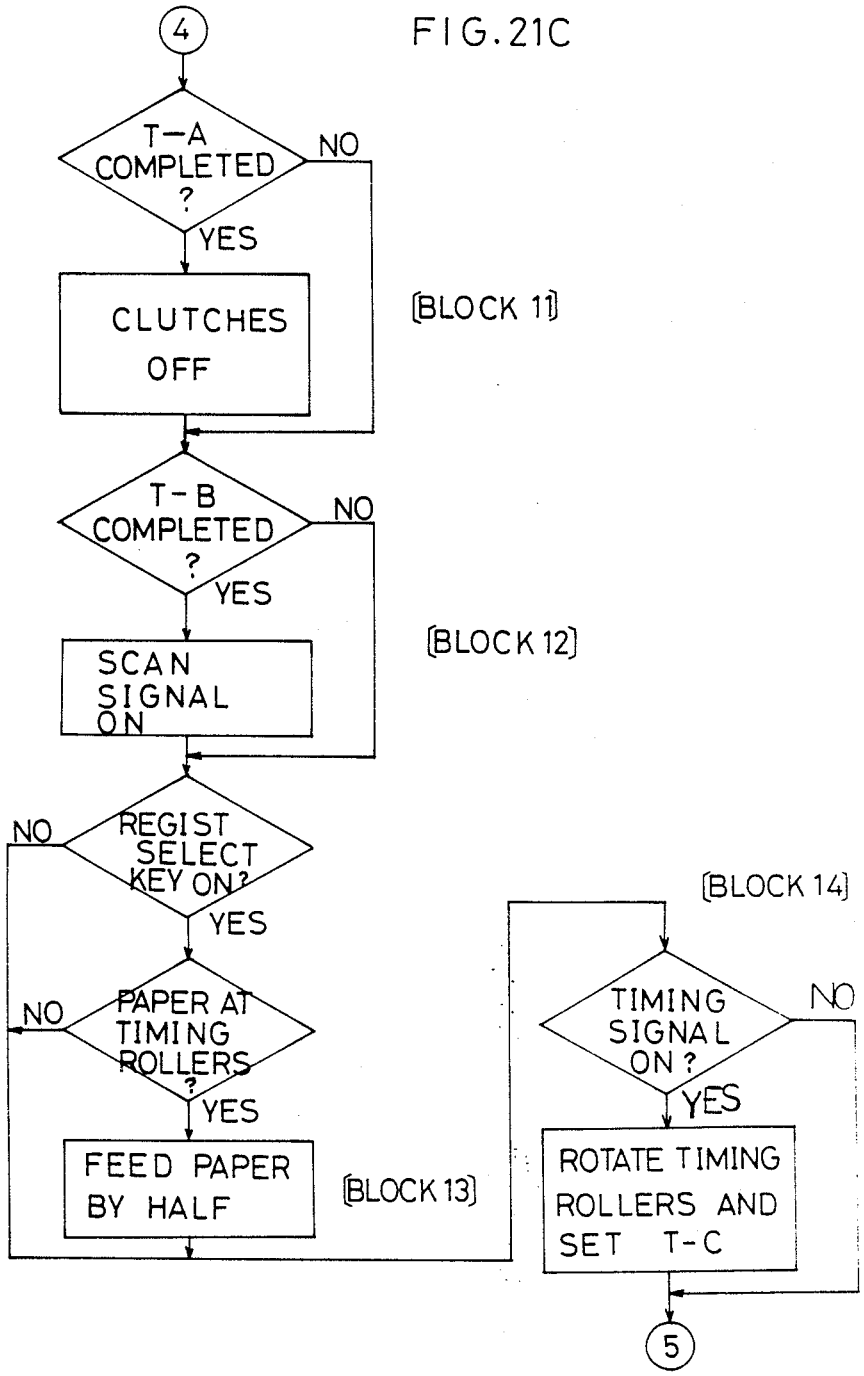
Figure 21D:
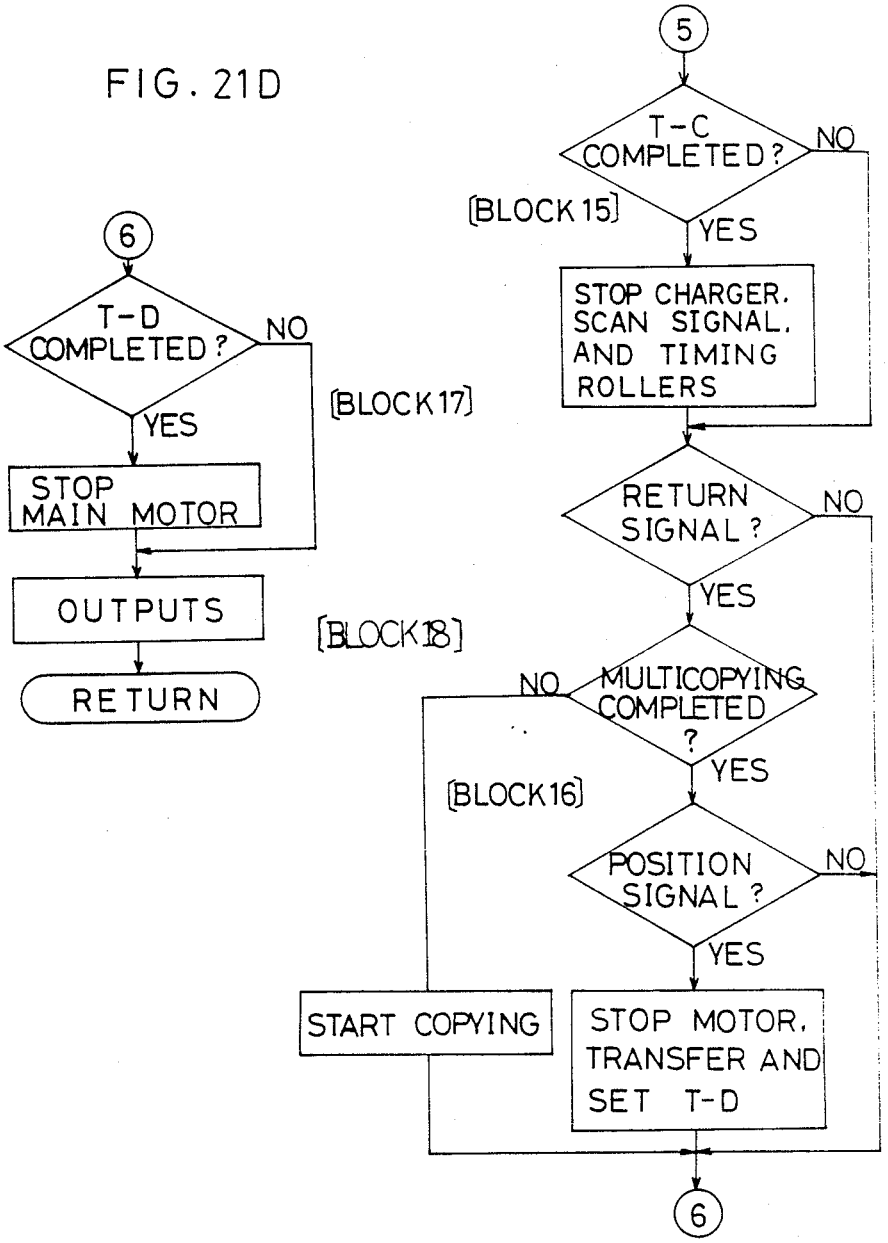

FIG. 20 shows an eraser control subroutine. The eraser 44 is turned off for an exposure area of an effective image portion on the document supporting glass plate 16, and is turned on for erasing an interimage portion between effective image portions. Thereafter, if the width of copying paper is known from turning-on of the indicator lamp 115 or 116, depending on the automatic paper feed or manual paper feed, the eraser 44 is turned on for side erase in accordance with the data of paper width and copy magnification.

FIG. 21 shows a control routine for controlling a copying operation of the copying machine A. If the manual paper feed is not selected, whether the automatic document feeder 300 is in use or not is judged with the on-edge state of print key 71. A copy start flag is set to "1" if the automatic document feeder 300 is out of use. If the feeder 300 is in use, an ADF start signal for starting the automatic document feeder 300 is set to "1" provided there is a document on the document tray 303. In the case of timing other than the on-edge state of print key 71 and the automatic document feeder 300 being in use, the copy start flag is set to "1" when a document position signal from the feeder 300 changes to "1". Thereafter, if the manual paper feed is selected, the same operation that takes place with the on-edge state of print key 71 is carried out with the on-edge state of sensor SE2 for detecting the copying paper manually fed from the manual paper feed table 41.

In block 10 of FIG. 21, the copy start flag is set to "1" to operate main motor M1 for driving the photoreceptor drum 1, developer motor M2 for driving the developing device 6, the charger 3 and 5 and transfer charger 7. Then the copy start flag is set to "0" to start control timers T-A and T-B and to engage a clutch of the paper feed rollers for a selected one of the upper paper feed section, the lower paper feed section and the manual paper feed section.

In block 11, the paper feed clutch is disengaged upon completion of the timer T-A.

In block 12, a scan signal is turned on upon completion of the timer T-B.

In block 13, if the image regist select key 96 is on, judgement is made as to whether the leading end of copying paper has reached the timing rollers 26 or not. If it has, the timing rollers 26 are rotated to advance the copying paper a distance corresponding to half its length.

In block 14, when the timing signal is output, a clutch for the timing rollers 26 is engaged and a timer T-C is set. The copying paper is transported by the timing rollers 26 in synchronism with the image on the photoreceptor drum 1.

In block 15, the chargers, scan motor and timing roller clutch are turned off upon completion of the timer T-C.

In block 16, when a return signal is set to "1", namely when a return operation is started, judgment is made as to whether a multicopying operation has completed or not. If it has not completed, the copy start flag is set to "1". If it has been completed, the return operation causes the optical system to return to an original position which turns on an original position switch not shown. Then the developer motor and the transfer charger are turned off and a timer T-D is set.

In block 17, the main motor is turned off upon completion of the timer T-D. Block 18 is for providing various outputs.

The timers T-A to T-D described with reference to the foregoing flowchart comprise digital timers so programmed as to be incremented by one with every routine of the operation carried out within a time period set by the internal timer, and completion times are stored as numerical data.

Figure 22:
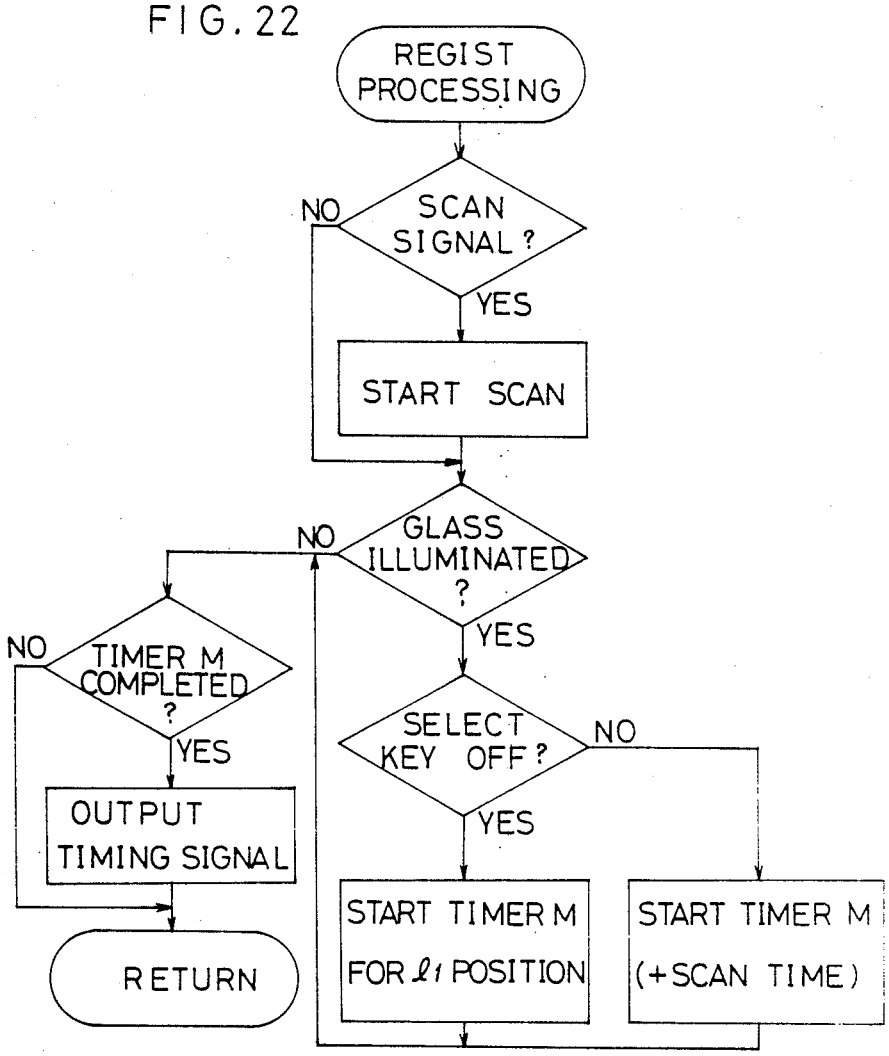
FIG. 22 is a flowchart showing a regist processing routine executed by a second CPU.

FIG. 22 shows a regist processing routine by the second CPU 202. Upon receipt of a scan signal from the first CPU 201, the optical system 10 starts a scanning action. Thereafter, in timed relation with a start of illumination of the document supporting glass plate 16, timer M is started. Timer M is set with a period of time required for a position of the photoreceptor drum 1 illuminated at that time to move to a position short of the transfer position by the distance l1 (=L) when the image regist key 96 is off, namely in the ordinary mode. When the image regist key 96 is on, namely in the center regist mode, the timer M is started with the above time period added with a period of time required for the optical system 10 to reach the central position PC of the document supporting glass plate 16 (a time taken for scanning a distance of 210 mm in this embodiment). These time periods are variable with different copying magnifications, and therefore the time periods corresponding to the copying magnifications are set for the timer M. Upon completion of the timer M, a timing signal is output to the first CPU 201.

FIGS. 23 through 28 show a control sequence by the third CPU 221.

Figure 23:
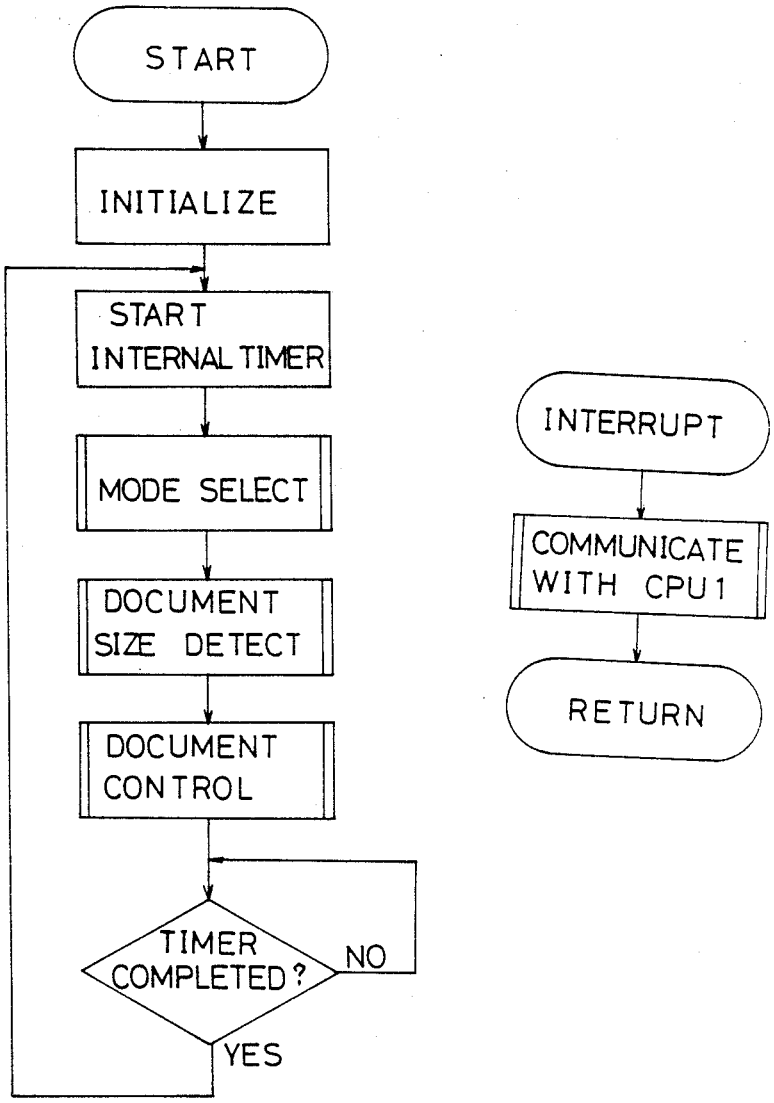
FIGS. 23, 24, 25, 26, 27, and 28 are flowcharts showing processing sequences executed by a third CPU.

FIG. 23 schematically shows the entire control sequence by the third CPU 221. When the program starts, the third CPU 221 and the automatic document feeder 300 are initialized and the internal timer is started thereafter. Then subroutines are called and executed in succession. One routine ends with completion of all the subroutines and the timing of the internal timer completed. The data communication with the first CPU 201 is effected by an interrupt routine upon an interrupt request from the first CPU 201 and independently of the main routine.

Figure 24:
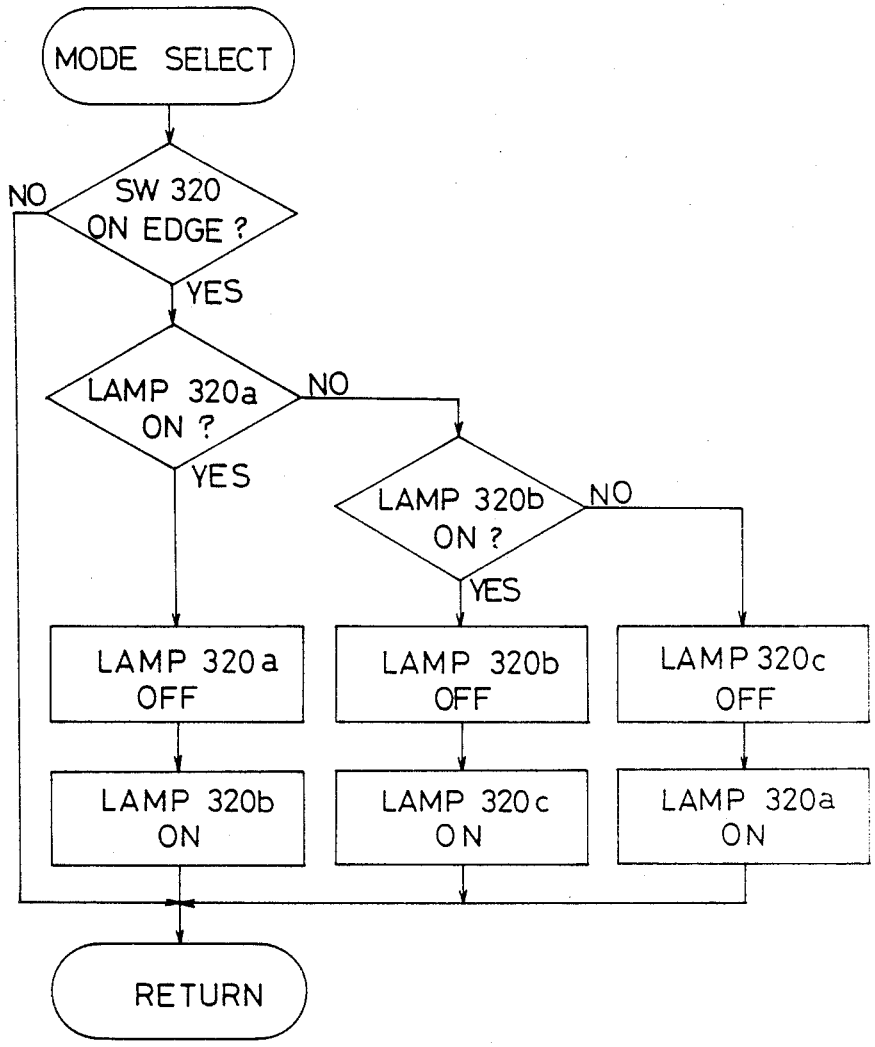

FIG. 24 shows a mode select subroutine. With an on-edge state of the mode select switch 320, a mode selection is made through a circuit of the automatic paper select mode, the automatic magnification select mode and the manual mode.

Figure 25:
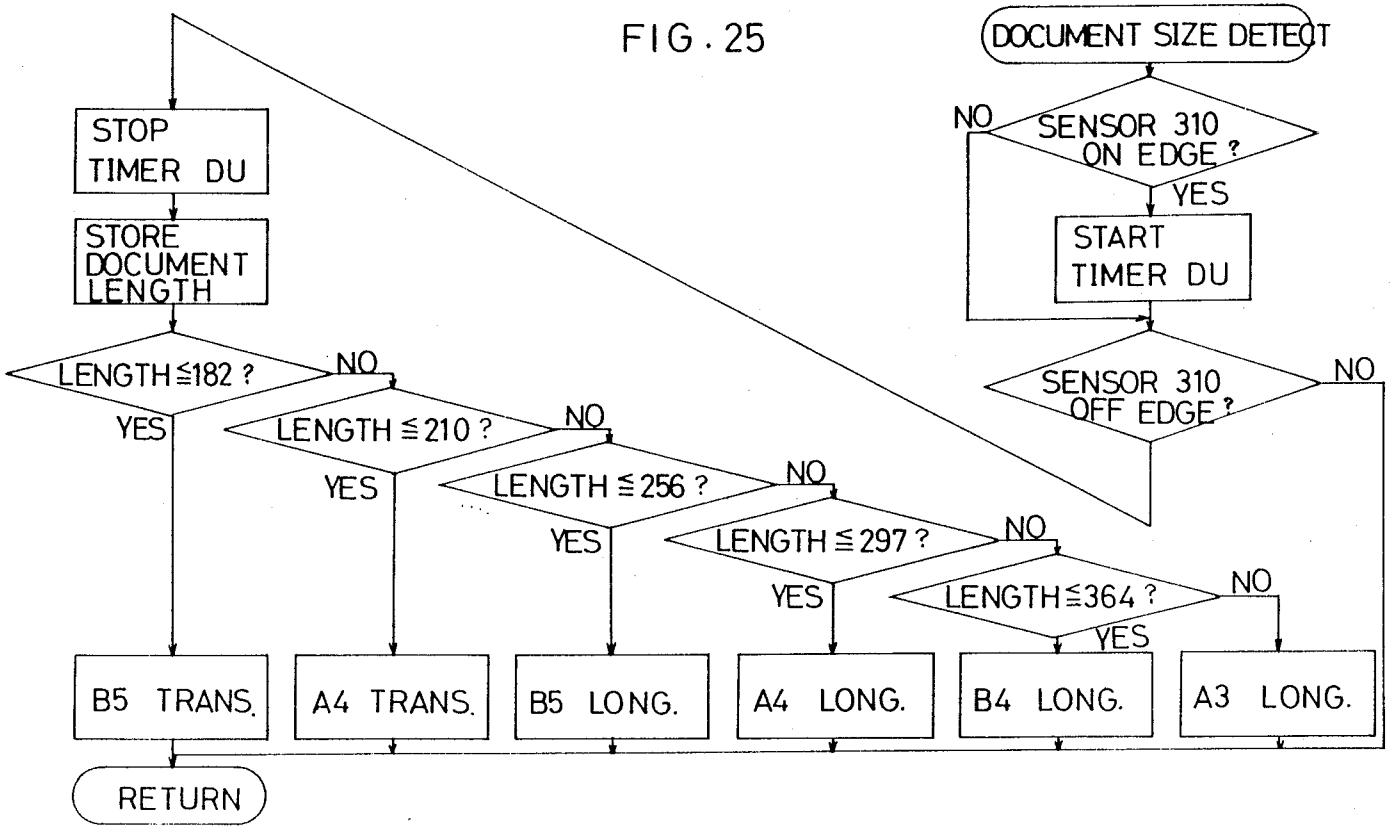

FIG. 25 shows a document size detect subroutine. A timer DU is started with an on-edge state of the sensor 310 for detecting passage of a document, and is stopped with an off-edge state of the sensor 310. Through these operations a time taken for the passage of the document is measured, which is multiplied by a document transport speed to provide a length of the document to be stored in A register. The value of A register provides the basis for determining the document size.

Figure 26:
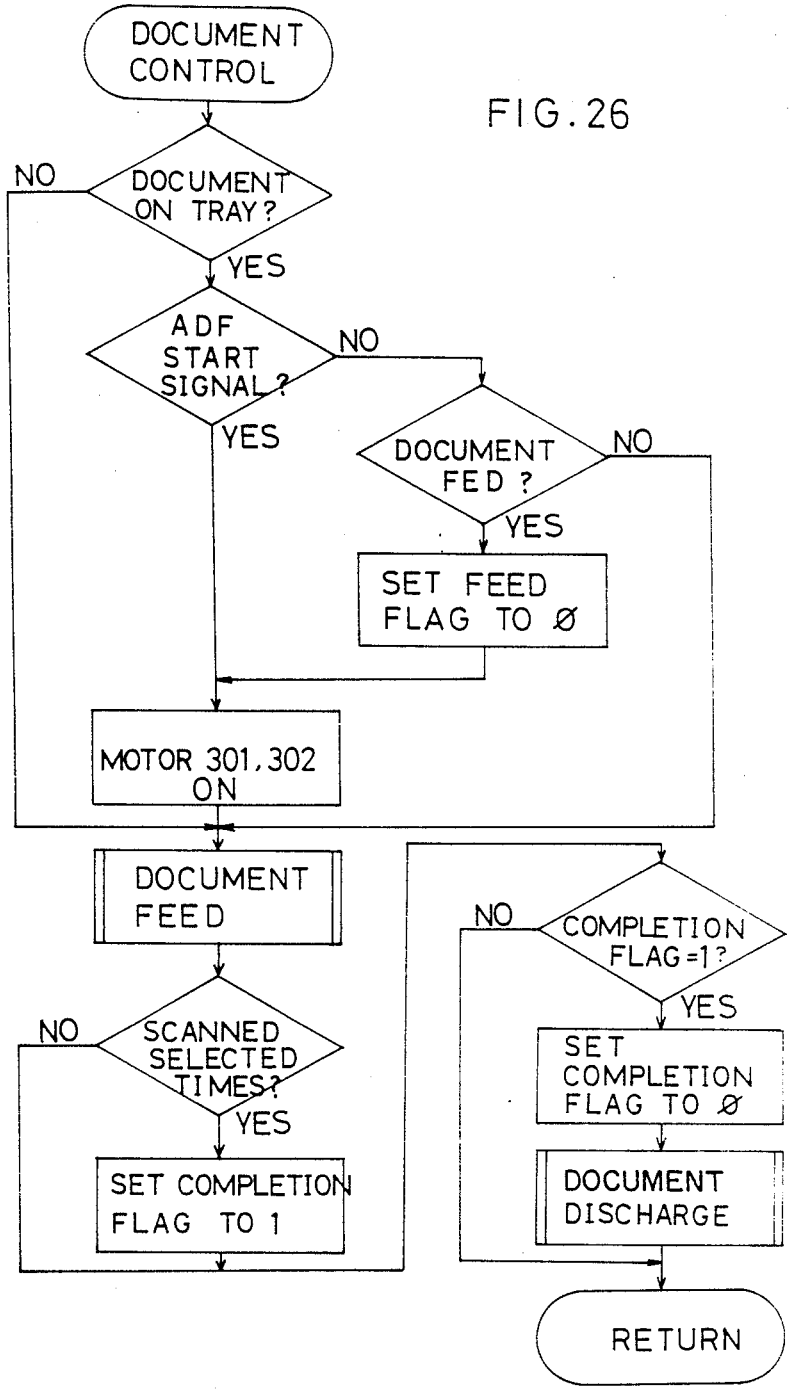

FIG. 26 shows a document control subroutine. When the sensor 311 detects a document on the document tray 303 and the ADF start signal is received from the first CPU 201 or a document feed flag is set to "1", the motor 302 for feeding the document and the motor 301 for driving the conveyor belt 304 are turned on. Thereafter, a document feed subroutine is executed to place the document in a predetermined position. When a scanning action is completed for a selected number of copies, a scan complete flag is set to "1" whereupon a document discharge subroutine is executed.

Figure 27:
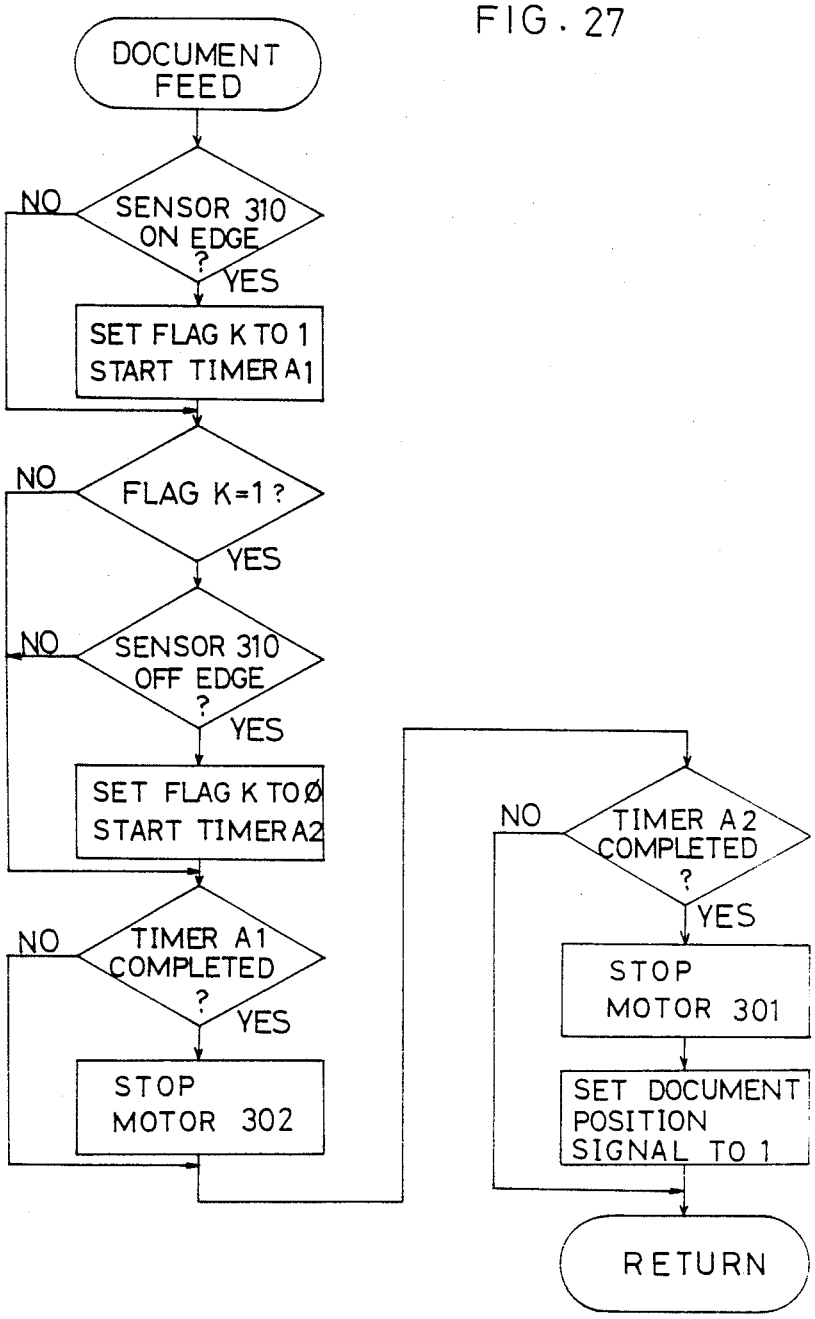

FIG. 27 shows the document feed subroutine. When the sensor 310 operates, a flag K is set to "1" and a timer A1 is started. The timer A1 is for turning off the motor 302 in timed relation with the document feed so that one document is followed by another, and is set with a period of time taken till the document reaches a position to be engaged by the conveyor belt 304. Next, when the sensor 310 becomes an off-edge state with the flag K set to "1" thereby detecting a rear end of the document, the flag K is set to "0" and a timer A2 is started. The timer A2 is set with a period of time taken for the rear end of the document to reach the end position PE of the document supporting glass plate 16 or with a period of time taken for the center of the document to reach the central position PC of the document supporting glass plate 16, which depends on the mode, i.e. the ordinary mode or the center regist mode, selected through the image regist select key 96. The motor 302 is turned off upon completion of the timer A1, and the motor 301 is turned off upon completion of the timer A2 whereupon a document position signal is transmitted to the first CPU 201.

Figure 28:
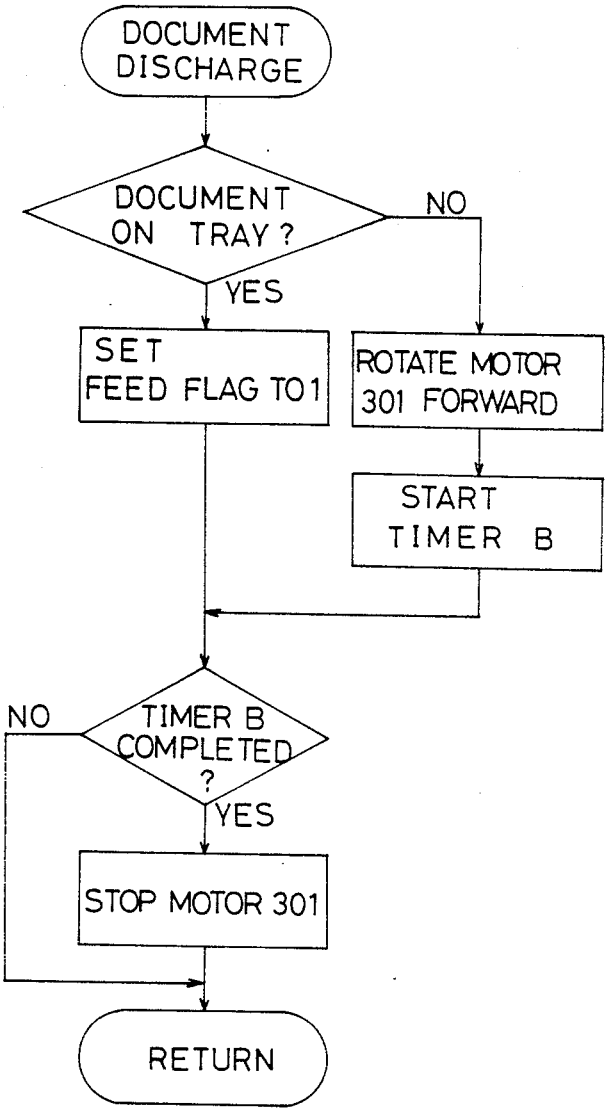

FIG. 28 shows the document discharge subroutine. The document feed flag is set to "1" if there is a document remaining on the document tray 303. If there is no further document on the tray 303, the motor 301 is rotated forward and a timer B is started. The timer B is set with a period of time required for discharge of a document having a maximum length. The motor 301 is turned off upon completion of the timer B.

In the described embodiment, selection may be made through the image regist select key 96 between the two modes, i.e. the ordinary mode and the center regist mode. This allows the conventional copying operation in which an end of document D and an end of copying paper PP are in register with each other, and a copying operation in which the center of document D and the center of copying paper PP are in register with each other. Particularly in the center regist mode copying, as in block 13 in the flowchart of FIG. 21, controls are effected such that the copying paper PP is advanced beforehand by the timing rollers 26 by a distance corresponding to half of the paper length, and the timing rollers 26 are rotated to further advance the copying paper PP upon completion of the timer M after a scanning action is started, the timer M being set with a time such that the portion at the central position PC of the document supporting glass plate 16 is copied to the center of copying paper PP. Consequently, the document D may simply be set to a predetermined position on the glass plate, i.e. the central position PC, regardless of the length of copying paper PP and the copying magnification. This facilitates control for the automatic document feeder 300 and, when the automtic document feeder 300 is not used, allows the document to be set with great ease without comsuming time by selecting a position to which the document should, be set and without the possibility of incorrectly setting the document. Furthermore, where the copying paper PP has a great length or in the case of a great magnification, a copy may be taken to the center of copying paper PP without any problem by setting the document to the central position PC.

According to the foregoing embodiment, two sizes of copying paper to be fed manually may be registered. This enables the manual feed copying operation to be carried out under control similar to the case of automatic paper feed from the upper paper feed section 20 or the lower paper feed section 22 by means of selection through the select switches 112 and 113. Consequently, a copy may be taken in the center regist mode to a sheet of paper outside regular sizes, such as wrapping paper, whereby the document is readily copied to the center of the paper.

Although in the foregoing embodiment the central position of the document supporting glass plate 16 with respect to the document feed direction is chosen as reference position PC, a position other than the central position may be chosen as reference position PC, and the timer M may just be set with a time in accordance with the predetermined reference position. Where the copying paper has a small length, the center regist mode may be realized by rotating the timing rollers 26 with a properly calculated timing after the leading end of copying paper comes into contact with the timing rollers 26, without rotating the timing rollers 26 to feed the copying paper PP by half its length in advance.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An electrophotographic copying machine comprising:

a document supporting glass plate for supporting an original document thereon;

a scanner for scanning the document on said document supporting glass plate;

a photoreceptor drum for recording an image scanned by said scanner;

timing rollers for feeding copying paper to which the image on said photoreceptor drum is transferred;

a reference position defined on said document supporting glass plate with respect to a direction of scanning by said scanner; and timing roller control means for controlling said timing rollers such that the image present on said photoreceptor drum when said scanner scans said reference position is transferred to a central position of said copying paper with respect to a copying paper feed direction.

2. An electrophotographic copying machine comprising:

a scanner for scanning a document;

a photoreceptor drum for recording an image scanned by said scanner;

transfer means for transferring the image on said photoreceptor drum to copying paper;

copying paper transport means for transporting said copying paper to said transfer means;

copying mode selecting means for selecting between a first copying mode in which the image on said photoreceptor drum is transferred to said copy paper starting at a leading region thereof, and a second copying mode in which the image on said photoreceptor drum is transferred to a central region of said copying paper;

copying paper size judging means for judging a size of copying paper and outputting a copying paper size signal corresponding to the size of copying paper;

image position judging means for judging a position of a leading end and a central position with respect to a peripheral direction of the image on said photoreceptor drum;

timing signal generating means for outputting, in said first copying mode, a timing signal a first predetermined time before the leading end of the image on said photoreceptor drum reaches said transfer means, and for outputting, in said second copying mode, a timing signal a second predetermined time before the central position of the image on said photoreceptor drum reaches said transfer means; and control means for controlling said copying paper transport means, in said first copying mode, to stop said copying paper once at a position from which a leading end of said copying paper reaches said transfer means in said first predetermined time and to advance said copying paper to said transfer means in response to said timing signal, and, in said second copying mode, to stop said copying paper once at a position from which a central position of said copying paper with respect to a copying paper feed direction reaches said transfer means in said second predetermined time and to advance said copying paper to said transfer means in response to said timing signal.

3. An electrophotographic copying machine as claimed in claim 2, wherein said image position judging means judges a reference position of the image on said photoreceptor drum corresponding to a reference position set to the document, from a position of said photoreceptor drum at a time when the reference position of the document is scanned by said scanner.

4. An electrophotographic copying machine comprising:

a document supporting plate for supporting an original document thereon;

image forming means for forming an image of the document onto copying paper, said image forming means including a scanner for scanning the image of the document on said document supporting plate, a photoreceptor member for recording the image scanned by the scanner and copying paper transport means for transporting copying paper to an image transferred position at which the image on said photoreceptor member is transferred thereon; and control means for controlling said image forming means such that the image according to a reference position which is defined on said document supporting plate with respect to a direction of scanning by said scanner is coincided with a central position of said copying paper with respect to a copy paper transport direction.

5. An electrophotographic copying machine as claimed in claim 4, wherein said reference position is defied at a central position of said document supporting plate with respect to said scanning direction.

6. An electrophotographic copying machine as claimed in claim 4, wherein said control means causes said copying paper transport means to stop a leading end of the copying paper once at a standby position set short of the image transferred position and to advance the copying paper to the image transferred position at a predetermined time before a predetermined position of the image on said photoreceptor member reaches said image transferred position.

7. An electrophotographic copying machine as claimed in claim 6, wherein said control means includes copying paper size judging means for judging a size of copying paper.

8. An electrophotographic copying machine comprising:

a scanner for scanning a document;

a photoreceptor drum for recording an image scanned by said scanner;

transfer means for transferring the image on said photoreceptor drum to copying paper;

copying paper transport means for transporting said copying paper to said transfer means;

copying mode selecting means for selecting between a first copying mode in which the image on said photoreceptor drum is transferred to said copy paper starting at a leading region thereof, and a second copying mode in which the image on said photoreceptor drum is transferred to a central region of said copying paper; and control means for controlling said copying paper transport means in accordance with the copying mode selected by said copying mode selecting means.

9. An electrophotographic copying machine as claimed in claim 8, wherein said control means causes the image according to a reference position which is defined on the document with respect to a direction of scanning by said scanner to be coincided with a central position of said copying paper with respect to a copy paper transport direction in the second copying mode.

10. An electrophotographic copying machine as claimed in claim 8, wherein said control means causes said copying paper transport means to stop a leading end of the copying paper once at a standby position set short of said transfer means; in the first copying mode, to advance the copying paper to the transfer means after a lapse of a first predetermined time from start of scanning, and in the second copying mode, to advance the same after a lapse of a second predetermined time longer than the first predetermined time from start of scanning.

* * * * *